US006367724B1

(12) United States Patent
Atkinson et al.

(10) Patent No.: US 6,367,724 B1
(45) Date of Patent: Apr. 9, 2002

(54) BI-DIRECTIONALLY COMPRESSIBLE DYE TUBE

(75) Inventors: Leon Eric Atkinson, Asheboro, NC (US); Franz Josef Hallmann, Wurselen (DE)

(73) Assignee: Technimark, Inc., Asheboro, NC (US)

( * ) Notice: Subject to any disclaimer, the term of this patent is extended or adjusted under 35 U.S.C. 154(b) by 0 days.

(21) Appl. No.: 09/591,333

(22) Filed: Jun. 9, 2000

(51) Int. Cl.[7] ..... B65H 75/20; D06F 17/02
(52) U.S. Cl. ..... 242/118.11; 68/189; 68/198
(58) Field of Search ..... 242/118.11, 118.1, 242/118.2, 118; 68/189, 198

(56) References Cited

U.S. PATENT DOCUMENTS

| | | | | |
|---|---|---|---|---|
| 3,448,597 A | | 6/1969 | Livingstone | |
| 3,647,156 A | | 3/1972 | Henning | 242/118.1 |
| 3,756,532 A | * | 9/1973 | Draper | 242/118.11 |
| 4,270,710 A | | 6/1981 | Ono | 242/118.11 |
| 4,454,734 A | * | 6/1984 | Marquis et al. | 242/118.11 X |
| 4,491,286 A | | 1/1985 | Nielsen | 242/118.11 |
| 4,519,557 A | | 5/1985 | Newman | 242/118.31 |
| 4,632,332 A | | 12/1986 | Newman | 242/118.3 |
| 4,702,433 A | | 10/1987 | Gilljam et al. | 242/118.1 |
| 4,720,057 A | * | 1/1988 | Ono et al. | 242/118.11 |
| 4,962,650 A | * | 10/1990 | Hahm | 242/118.11 X |
| 5,445,335 A | * | 8/1995 | Hallmann et al. | 242/118.11 X |
| 5,501,406 A | * | 3/1996 | Henning | 242/118.11 |
| 5,577,677 A | | 11/1996 | Frings et al. | 242/118.11 |
| 5,632,451 A | * | 5/1997 | Pasini | 242/118.11 |
| 5,820,049 A | | 10/1998 | Atkinson et al. | 242/118.1 |

FOREIGN PATENT DOCUMENTS

| | | | | |
|---|---|---|---|---|
| EP | 0 354 601 A1 | * | 2/1990 | 242/118.11 |
| EP | 0 471 353 A1 | * | 2/1992 | 242/118.11 |
| FR | 2659309 | | 9/1991 | |

* cited by examiner

*Primary Examiner*—Michael R. Mansen
(74) *Attorney, Agent, or Firm*—MacCord Mason PLLC

(57) ABSTRACT

A bi-directionally compressible dye tube that is designed to both axially and radially compress to a predetermined position. The tube includes a pair of solid end caps at the distal ends of an open structure which allows for dye liquor to pass through the structure and onto yarn that can be wrapped upon the open structure. The open structure between the solid end caps includes a plurality of axially rigid zones. In the preferred embodiment, the axially rigid zones may be compressed radially inwardly as the force of the yarn squeezes the tube inwardly. Between the plurality of axially rigid zones, there exists interlocking linear ribs. These interlocking linear ribs allow for the axially compression of the dye tube, in the space between the plurality of axially rigid zones. The interlocking linear ribs are spaced to allow only a limited amount of axial compression. In order to connect the axially rigid zones to one another, there is provided on the dye tube in a preferred embodiment a bi-axially flexible connector. The bi-axially flexible connector allows the tube to axially compress to the degree allowed by the interlocking linear ribs, but also to radially compress to the degree allowed by the circular detail.

30 Claims, 3 Drawing Sheets

BI-DIRECTIONALLY COMPRESSIBLE DYE TUBE

BACKGROUND OF THE INVENTION (1) Field of the Invention

The present invention relates generally to yam carriers and, more particularly, to a plastic dye tube designed to compress both radially and longitudinally.

(2) Description of the Prior Art

It is known in the art to provide dye tubes that may be designed to compress axially after the yarn has been wound on the tube to relax the yarn, thereby permitting more uniform dyeing, and to increase the amount of yarn which can be dyed at one time. It is also known in the art to provide a dye tube designed to be axially and radially rigid, thereby allowing for more yarn to be wound upon the dye tube. With rigid dye tubes, the package typically is made so rigid to withstand the dynamics of the dye bath environment, that the yarn wound adjacent to the dye tube would become flattened against the tube and thereby have different dyed characteristics due to its flattened condition.

In addition, the stacking of dye tubes one upon the other in the dye bath causes a static load upon the lower packages. The additional dynamic force added by the pressures within the dye bath causes many dye tubes to become flared out at the bottom. The flaring causes the stack of tubes to shorten and allow for dye liquor to pass unimpeded between tubes rather than through the yarn as desired.

None of the tubes of the prior art allows for a predetermined amount of radial compression and axial compression. Thus there remains a need for a new and improve dye tube, which is bi-directionally compressible to fixed positions predetermined by customer requirements.

SUMMARY OF THE INVENTION

The present invention is directed to a bi-directionally compressible dye tube that is designed to both axially and radially compress to a predetermined position. The tube includes a pair of solid end caps at the distal ends of an open structure. This open structure allows for dye liquor to pass through the structure and onto yarn that can be wrapped upon the open structure. The open structure generally includes a plurality of radial rings and linear ribs. The open structure between the solid end caps is make up of a plurality of axially rigid zones.

In the preferred embodiment, the axially rigid zones consist of radial rings and linear ribs. In each of the radial rings of the axially rigid zones, there is placed a circular detail which allows the axially rigid zone to be compressed radially inwardly as the force of the yarn squeezes the tube inwardly. The circular detail allows for the radial ring to compress and come in contact with a linear rib that extends through the circular detail. This linear rib only allows a certain amount of compression of the radial ring.

Between the plurality of axially rigid zones, there exists interlocking linear ribs. These interlocking linear ribs allow for the axially compression of the dye tube, in the space between the plurality of axially rigid zones. The interlocking linear ribs are spaced to allow only a limited amount of axial compression. In order to connect the axially rigid zones to one another, there is provided on the dye tube in a preferred embodiment a bi-axially flexible connector. The bi-axially flexible connector allows the tube to axially compress to the degree allowed by the interlocking linear ribs, but also to radially compress to the degree allowed by the circular detail.

Accordingly, one aspect of the present invention is to provide a bi-directionally compressible plastic dye tubes. The tube includes a pair of end caps; and an open structure between the pair of end caps to permit dye to pass through the structure, the structure including a plurality of spaced axially rigid zones.

Accordingly, another aspect of the present invention is to provide a bi-directionally compressible plastic dye tubes. The tube includes a pair of end caps; an pen structure between the pair of end caps to permit dye to pass through the structure, the structure including a plurality of spaced axially rigid zones; and bi-axially flexible connectors interconnected between each of the spaced axially rigid ones.

Accordingly, still another aspect of the present invention is to provide a bi-directionally compressible plastic dye tubes. The tube includes a pair of end caps; an open structure between the pair of end caps to permit dye to pass through the structure, the structure including a plurality of spaced axially rigid zones; bi-axially flexible connectors interconnected between each of the spaced axially rigid zones; and a plurality of radially compressible elements in at least one of the axially rigid zones.

These and other aspects of the present invention will become apparent to those skilled in the art after a reading of the following description of the preferred embodiment when considered with the drawings.

DESCRIPTION OF THE PREFERRED EMBODIMENT

Figure 1:
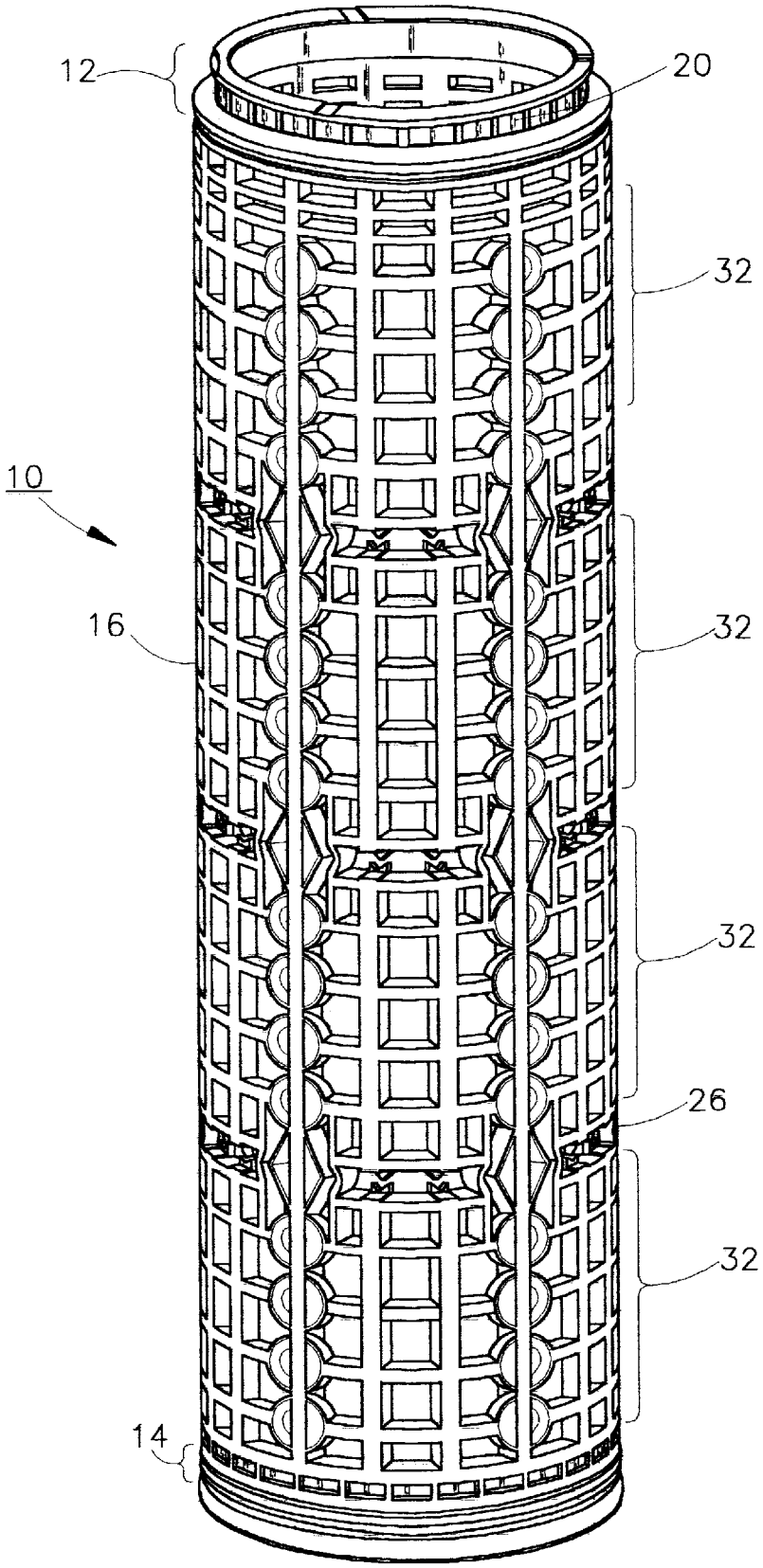
FIG. 1 is a perspective view illustrating a bi-directionally compressible plastic dye tube constructed according to the present invention.
Figure 2:
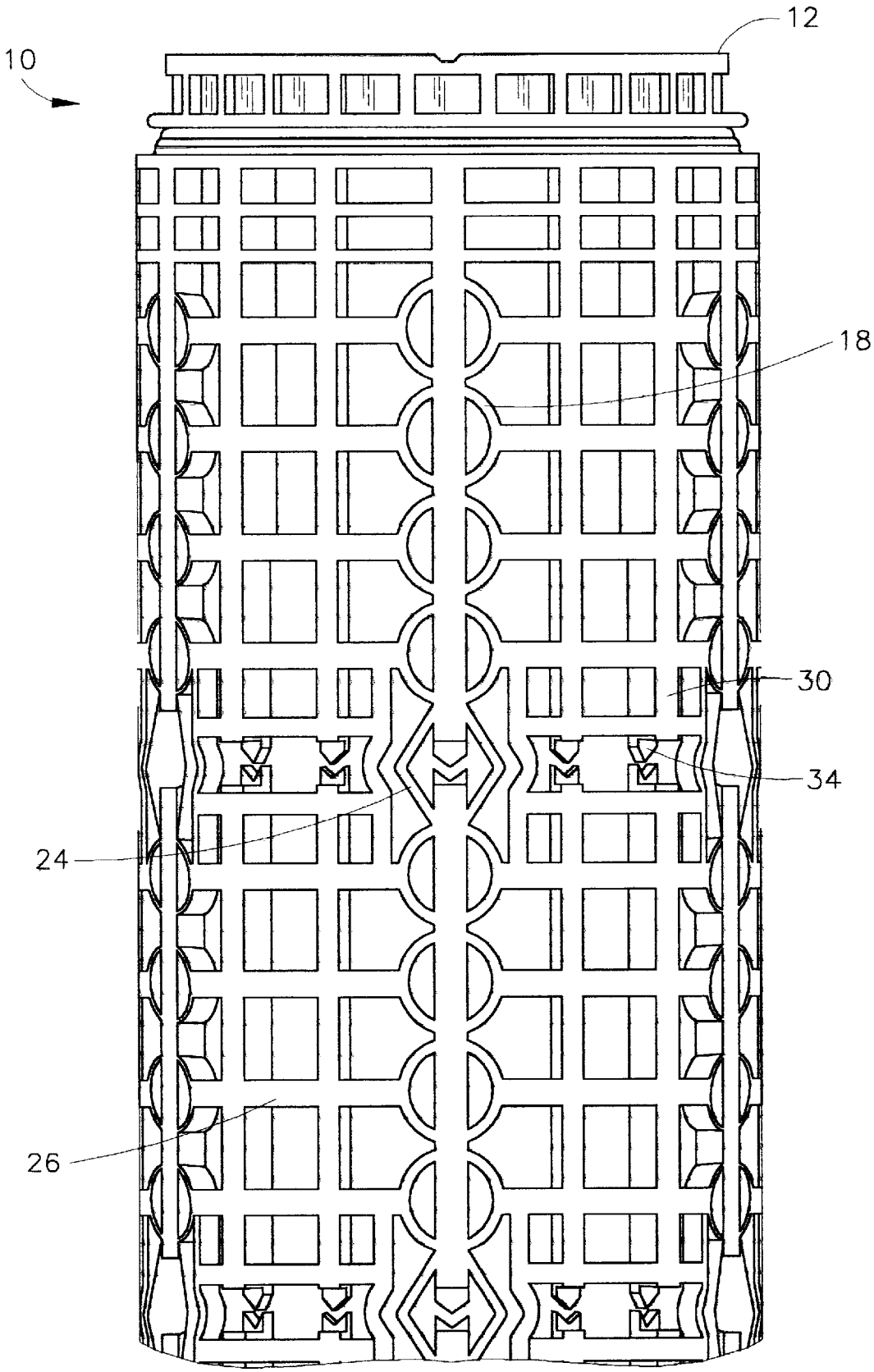
FIG. 2 is a view of the dye tube shown in FIG. 1 illustrating the details of the structure of the dye tube between the end caps.
Figure 3:
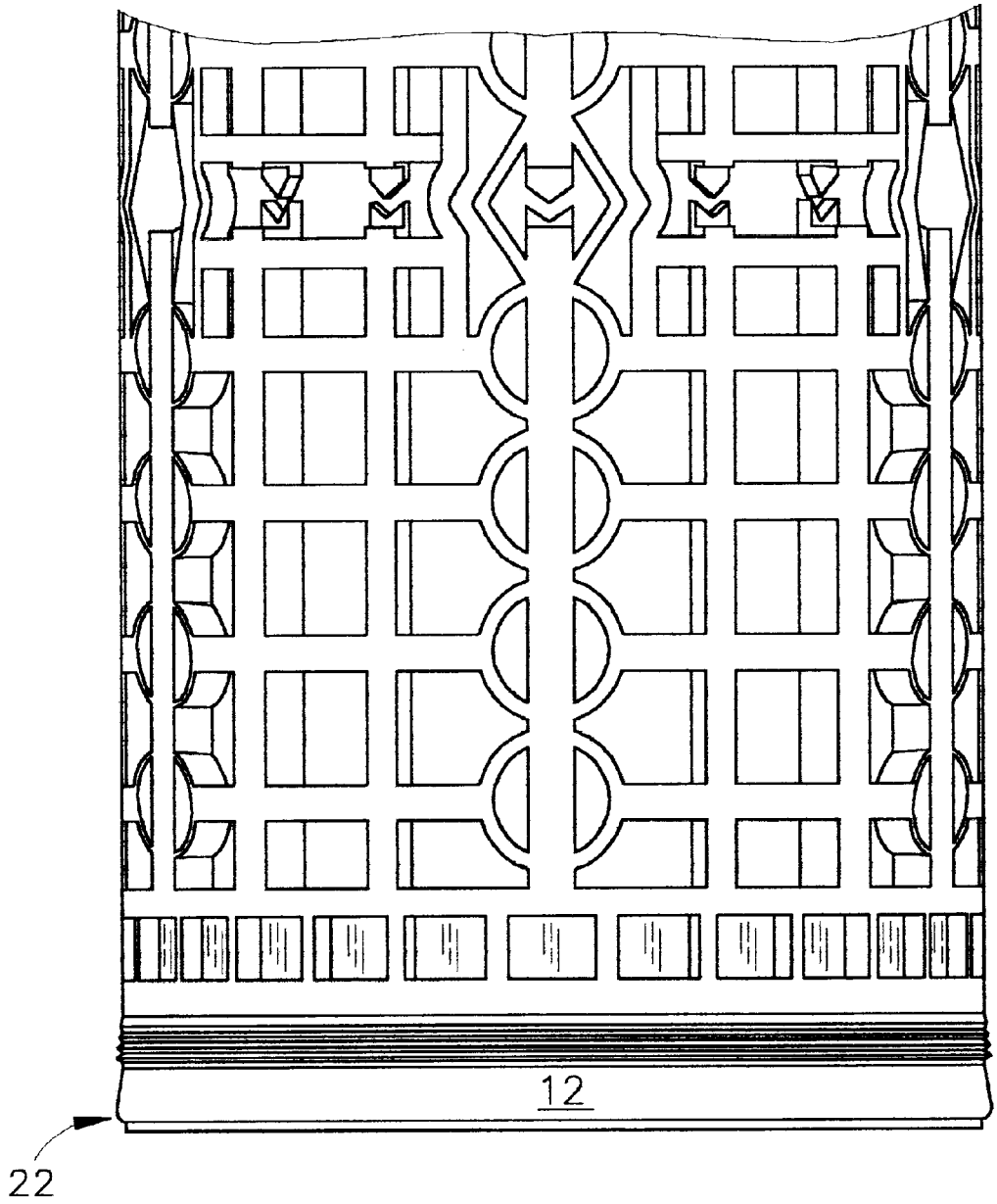
FIG. 3 is a view of one end of the dye tube shown in FIG. 1.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto.

As best seen in FIG. 1, the plastic dye tube, generally designated 10, is shown and constructed according to the present invention. The tube is in the shape of a hollow cylinder with an open wall structure 16. The tube has two end caps, a male end cap 12 and a female end cap 14. The end caps are designed so that the male end cap 12 of one tube fits snuggly within female end cap 14 of another tube. This permits the tubes to be stacked on top of each other during the dyeing process.

A groove 20 is located on the male end cap 12. The groove 20 is in an area on the male end cap 12 having a smaller external diameter than the greatest external diameter of the male end cap 12. When the male end cap is placed inside the female end cap of an adjacent tube, a channel is created that is used to retain a transfer tail of yarn within the groove 20. See, for example, U.S. Pat. No. 4,702,433.

Between the two end caps 12 and 14, the body of the tube is a hollow plastic cylinder with an open structure 16. The open structure 16 has a plurality of concentric axially rigid zones 32. Each of the axially rigid zones is made up of linear ribs 30 and concentric radial rings 26. At least one of the axially rigid zones 32 has a plurality of radially compressible elements 18 located within the radial rings 26.

The axially rigid zones 32 are connected by bi-directionally flexible connectors 24. Linear ribs with interlocking devices 34 are provided between the plurality of axially rigid zones in order to allow for a limited amount of axial compression of the dye tube 10.

The bi-directionally compressible dye tube of the present invention is formed by injection molding process. In order to obtain the required rigidity to allow reworking without collapsing or cracking the specific material properties have been found to be required. For certain applications wherein the dye tube will be used in an aggressive dye bath, a homopolymer polypropylene as disclosed in U.S. Pat. No. 5,820,049 is the preferred material. For dye tubes used in a less aggressive environment, a copolymer such as taught by U.S. Pat. No. 5,577,677 is the preferred embodiment. The female end cap 14 is provided with a barrier 22 adjacent to the distal end of the female end cap 14. The barrier 22 is typically an additional ridge on the female end cap 14. Dye tubes often experience damages from handling. The damage, resulting in deformation of the female end cap 14, causes yarn to snag during run off. The barrier 22 allows for the yarn to be protected from any damage or deformation on the distal end of the female end cap 14.

In the preferred embodiment, the radially compressible elements of the bi-directionally compressible dye tube allow the outer diameter to be reduced by less than about 20% and, most preferably, about 15%.

Also, in the preferred embodiment, the linear ribs have a depth measured radially from the inside surface of the dye tube to the outside surface of the dye tube and a surface width, wherein the ratio of the depth to the surface width is greater than about 1 and, most preferably, about 1.5.

Finally, in the preferred embodiment, the bi-directionally compressible dye tube has a specified dimensional length, and wherein the ratio of the space between the interlocking linear ribs to the overall tube linear dimension is greater than about 5 to 285 and, most preferably, about 6 to 285.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A bi-directionally compressible plastic dye tubes, said tube comprising, (a) a pair of end caps; and (b) an open structure between said pair of end caps to permit dye to pass through said structure, said structure including a plurality of spaced axially rigid zones, wherein the space between said spaced axially rigid zones further includes pairs of interlocking linear ribs to limit the amount of longitudinal axially compression of said dye tube.

2. The bi-directionally compressible dye tube according to claim 1 further including a plurality of radially compressible elements in at least one of said axially rigid zones.

3. The bi-directionally compressible dye tube according to claim 2, wherein said radially compressible elements are compressible substantially in only one direction.

4. The bi-directionally compressible dye tube according to claim 3, wherein said radially compressible elements are substantially ring shaped.

5. The bi-directionally compressible dye tube according to claim 4, wherein said radially compressible elements are substantially ring shaped having a linear rib contained within the ring.

6. The bi-directionally compressible dye tube according to claim 3, wherein said open structure has an outer diameter, and said radially compressible elements allow said outer diameter to be reduced by less than about 20%.

7. The bi-directionally compressible dye tube according to claim 6, wherein said outer diameter is reduced by about 15%.

8. A bi-directionally compressible plastic dye tubes, said tube comprising, (a) a pair of end caps;

(b) an open structure between said pair of end caps to permit dye to pass through said structure, said structure including a plurality of spaced axially rigid zones, wherein the space between said spaced axially rigid zones further includes pairs of interlocking linear ribs to limit the amount of longitudinal axially compression of said dye tube; and (c) bi-axially flexible connectors interconnected between each of said spaced axially rigid zones.

9. The bi-directionally compressible dye tube according to the invention of claim 8, wherein said end caps are substantially solid.

10. The bi-directionally compressible dye tube according to the invention of claim 8, wherein said end caps include a male end cap and a female end cap, and said end caps allow one tube to stack upon an adjacent tube of similar configuration.

11. The bi-directionally compressible dye tube according to the invention of claim 10, further including a groove upon said male end cap allowing for the protection of a transfer tail of yarn placed upon said dye tube.

12. The bi-directionally compressible dye tube according to the invention of claim 8, wherein said female end cap further includes a barrier located adjacent to the distal end of said female end cap, said barrier to prevent yarn placed upon said dye tube from being snagged by tube deformations on said distal end.

13. The bi-directionally compressible dye tube according to claim 8, wherein said linear ribs have a depth measured radially from the inside surface of said dye tube to the outside surface of said dye tube and a surface width, wherein said ratio of said depth to said surface width is greater than about 1.

14. The bi-directionally compressible dye tube according to claim 13, wherein said ratio of said depth to said surface width is about 1.5.

15. The bi-directionally compressible dye tube according to claim 8, wherein said tube has a specified dimensional length, and wherein the ratio of the space between said interlocking linear ribs to said overall tube linear dimension is greater than about 5 to 285.

16. The bi-directionally compressible dye tube according to claim 15, wherein said ratio of the space between said interlocking linear ribs to said overall tube linear dimension is about 6 to 285.

17. A bi-directionally compressible plastic dye tubes, said tube comprising, (a) a pair of end caps;

(b) an open structure between said pair of end caps to permit dye to pass through said structure, said structure including a plurality of spaced axially rigid zones, wherein the space between said spaced axially rigid zones further includes pairs of interlocking linear ribs to limit the amount of longitudinal axially compression of said dye tube;

(c) bi-axially flexible connectors interconnected between each of said spaced axially rigid zones; and (d) a plurality of radially compressible elements in at least one of said axially rigid zones.

18. The bi-directionally compressible dye tube according to claim 17, wherein said radially compressible elements are compressible substantially in only one direction.

19. The bi-directionally compressible dye tube according to claim 18, wherein said radially compressible elements are substantially ring shaped.

20. The bi-directionally compressible dye tube according to claim 19, wherein said radially compressible elements are substantially ring shaped having a linear rib contained within the ring.

21. The bi-directionally compressible dye tube according to claim 18; wherein said open structure has an outer diameter, and said radially compressible elements allow said outer diameter to be reduced by less than about 20%.

22. The bi-directionally compressible dye tube according to claim 21, wherein said outer diameter is reduced by about 15%.

23. The bi-directionally compressible dye tube according to the invention of claim 17, wherein said end caps are substantially solid.

24. The bi-directionally compressible dye tube according to the invention of claim 17, wherein said end caps include a male end cap and a female end cap, and said end caps allow one tube to stack upon an adjacent tube of similar configuration.

25. The bi-directionally compressible dye tube according to the invention of claim 24, further including a groove upon said male end cap allowing for the protection of a transfer tail of yam placed upon said dye tube.

26. The bi-directionally compressible dye tube according to the invention of claim 17, wherein said female end cap further includes a barrier located adjacent to the distal end of said female end cap, said barrier to prevent yarn placed upon said dye tube from being snagged by tube deformations on said distal end.

27. The bi-directionally compressible dye tube according to claim 17, wherein said linear ribs have a depth measured radially from the inside surface of said dye tube to the outside surface of said dye tube and a surface width, wherein said ratio of said depth to said surface width is greater than about 1.

28. The bi-directionally compressible dye tube according to claim 27, wherein said ratio of said depth to said surface width is about 1.5.

29. The bi-directionally compressible dye tube according to claim 17, wherein said tube has a specified dimensional length, and wherein the ratio of the space between said interlocking linear ribs to said overall tube linear dimension is greater than about 5 to 285.

30. The bi-directionally compressible dye tube according to claim 29, wherein said ratio of the space between said interlocking linear ribs to said overall tube linear dimension is about 6 to 285.

* * * * *